US005917278A

United States Patent [19]

Miyauchi et al.

[11] Patent Number: 5,917,278

[45] Date of Patent: Jun. 29, 1999

[54] ELECTROLUMINESCENT DISPLAY HAVING INCREASED LUMINESCENT AREA

[75] Inventors: Yoshiaki Miyauchi; Hiroshi Yamazaki, both of Tokyo, Japan

[73] Assignee: Seiko Precision Inc., Japan

[21] Appl. No.: 08/741,366

[22] Filed: Oct. 30, 1996

[30] Foreign Application Priority Data

Oct. 30, 1995 [JP] Japan ..... 7-281816

[51] Int. Cl.[6] ..... H01D 63/04

[52] U.S. Cl. ..... 313/506; 368/67

[58] Field of Search ..... 313/507, 506, 313/502, 505, 509; 362/23, 26, 27, 28, 29, 34, 62, 84; 368/67, 226, 227

[56] References Cited

U.S. PATENT DOCUMENTS 4,775,964 10/1988 Alessio et al. ..... 368/67
5,265,071 11/1993 Thorgersen et al. ..... 368/67
5,346,718 9/1994 Thorgersen et al. ..... 313/506
5,491,379 2/1996 Daigle et al. ..... 313/506

*Primary Examiner*—Sandra O'Shea
*Assistant Examiner*—Matthew J. Gerike
*Attorney, Agent, or Firm*—Adams & Wilks

[57] ABSTRACT

An EL display comprises a transparent substrate and a first electrode layer made of a transparent material disposed on the transparent substrate. A luminescent layer, a first insulation layer and a second electrode layer are disposed successively on a surface of the first electrode layer except for a preselected surface portion thereof defining an exposed portion. A second insulation layer is disposed on a surface of the second electrode layer except for a preselected surface portion thereof defining an exposed portion. A first contact layer is disposed on the exposed portion of the second electrode layer for electrical connection to an external driving control circuit. A second contact layer is disposed on the second insulation layer for electrical connection to the exposed portion of the first electrode layer and to the external driving control circuit.

21 Claims, 5 Drawing Sheets

ELECTROLUMINESCENT DISPLAY HAVING INCREASED LUMINESCENT AREA

FIELD OF THE INVENTION

The present invention relates to an electroluminescent (hereinafter referred to as "EL") display used as an EL face of a watch or other device.

BACKGROUND OF THE INVENTION

An EL element in a prior art EL display has been formed by laminating a transparent electrode layer, a luminescent layer, an insulation layer and a back electrode layer, and attaching electrode connecting portions which project respectively from the transparent electrode layer and the back electrode layer for applying an AC electric field between the transparent electrode layer and the back electrode layer. Flat cables and the like are connected to the electrode connecting portions to electrically connect the EL display with an external driving control circuit.

Further, as a prior art technology pertaining to wristwatches, there has been known an EL display in which a transparent electrode layer is connected with an electrode by an electrode connecting portion formed by extending the transparent electrode layer, and a back electrode layer is connected with an electrode by an electrode contact layer provided on the back of the back electrode layer, such as shown in U.S. Pat. No. 5,265,071. In this technology, the transparent electrode layer is rendered conductive with the electrode by winding the electrode connecting portion of the transparent electrode layer around the side of a frame and by screwing to the electrode of a circuit board provided on the back of the frame.

However, if the electrode connecting portion is formed so as to project toward the outside like the above-mentioned prior art technology, the luminescent area of the EL display is reduced because the electrode connecting portion is a non-luminescent area. Further, a cavity portion has to be provided on the side of a case corresponding to the projecting electrode connecting portion, thus requiring a complicated mold and increasing the cost. Moreover, because the electrode connecting portion is provided so as to project within a small area at an extremely limited specific position in order to minimize the non-luminescent area, there have been such problems that the connecting position at which the electrode connecting portion is connected with the driving circuit is naturally limited into a narrow range and a high precision positioning is required, thus increasing the cost of the assembly process.

U.S. Pat. No. 5,265,071 has had another problem, beside the above-mentioned problems, in that it requires high precision processing in narrow sections to provide screw holes, for example, on the electrode connecting portion, the frame and the circuit board to screw the electrode connecting portion of the transparent electrode layer.

SUMMARY OF THE INVENTION

An object of the present invention is to provide an EL display which overcomes the aforementioned problems associated with the prior art EL displays.

According to the present invention, a pair of contact layers for electrical connection to a driving control circuit are disposed on the back of a back electrode which is superimposed on a luminescent area of an EL element by making the most use of the screen printing technology without extending a non-luminescent area toward the outside, in order to relatively increase a luminescent area and to facilitate the connection with the driving circuit.

An EL display of the present invention has a transparent electrode layer formed on the back of a transparent substrate, a part of the peripheral portion of the face of the transparent electrode layer being left as an exposed portion. A luminescent layer, a first insulation layer and a back electrode layer are coated successively on the remaining face of the transparent electrode layer, a part of the back electrode layer being left as an exposed portion, and a second insulation layer is coated on the remaining face of the back electrode layer. A contact layer of the back electrode layer is formed on the exposed portion of the back electrode layer, and a contact layer of the transparent electrode layer which electrically connects with the exposed portion of the transparent electrode layer is formed on the back of the second insulation layer. Contact terminal portions of an external driving control circuit are connected with the respective contact layers of the transparent electrode layer and the back electrode layer.

The respective contact layers of the transparent electrode layer and the back electrode layer may be formed in the shape of concentric arcs.

Alternatively, the contact layer of the back electrode layer may be formed in a circle at the center part and the contact layer of the transparent electrode layer may be formed in a ring-like shape at the peripheral portion of the circle.

As another alternative, the contact layer of the back electrode layer may be formed in a semi-circle and the contact layer of the transparent electrode layer may be formed in a complementary semi-circle.

Preferably, a back protection layer made of an insulating material is formed over the second insulation layer such that the respective part of each contact layer is exposed through apertures in the back protection layer.

DETAILED DESCRIPTION OF THE INVENTION

Figure 1:
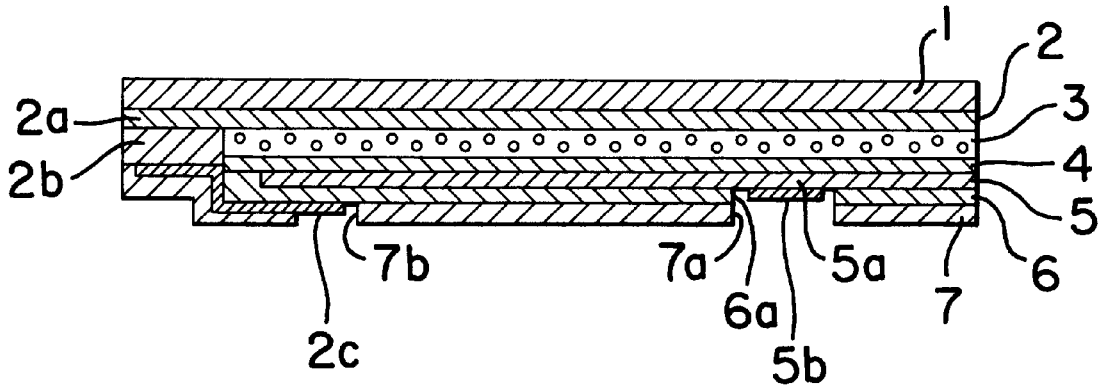
FIG. 1 is a cross-sectional view showing a main part of an EL display according to the present invention.

FIG. 1 shows a cross section of an inventive EL display wherein a transparent electrode layer 2 is formed by evaporating ITO on a transparent substrate 1 which is made of a synthetic resin, such as a surface of a PET film. Then, leaving a part of the peripheral portion of the transparent electrode layer 2 as an exposed portion 2*a*, a luminescent layer 3, a first insulation layer 4 and a back electrode layer 5 are formed sequentially on the remaining portion of the face of the transparent electrode layer 2 by means of screen printing and the like.

For the luminescent layer 3, ink produced by mixing and agitating a luminescent substance in which copper is doped in zinc sulfide, i.e., a luminescent material, with a fluororesin binder may be used. For the first insulation layer 4, ink produced by mixing and agitating barium titanate, i.e., a high dielectric substance, with fluorine binder may be used. The back electrode layer 5 is made from carbon paste.

A take-out electrode 2*b* of the transparent electrode layer 2 is formed by carbon paste on the exposed portion 2*a* at a part of the peripheral portion of the transparent electrode layer 2 which is insulated from the back electrode layer 5. The take-out electrode 2*b* is formed by printing at the same time that the back electrode layer 5 is printed.

Figure 2:
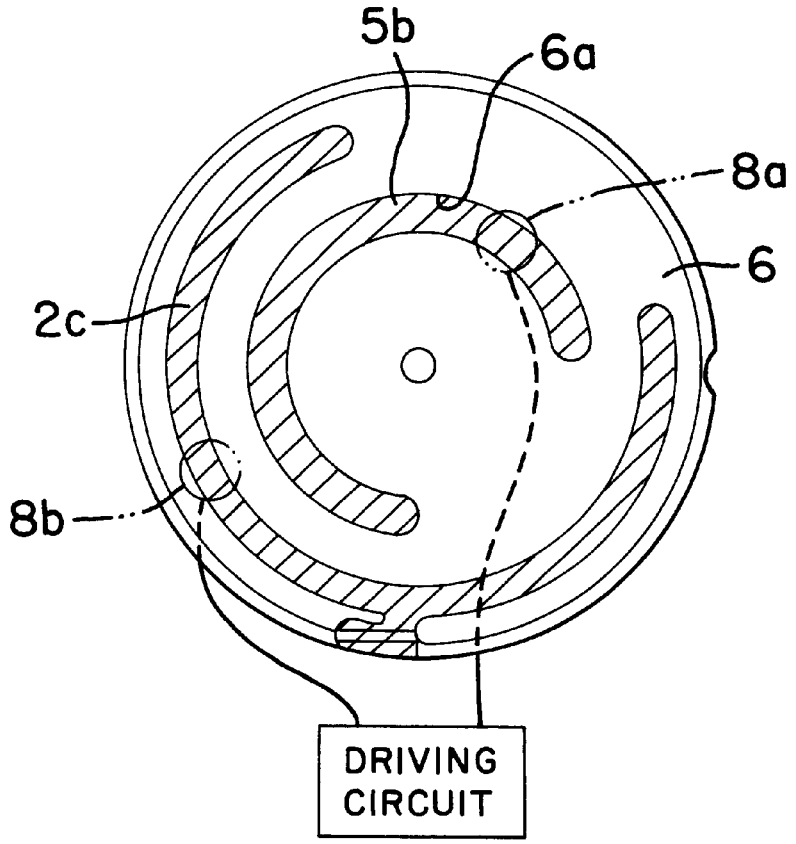
FIG. 2 is a rear view thereof in a state before a back protection layer is formed.

A second insulation layer 6 is formed on the back electrode layer 5. While the same ink as that used for the first insulation layer 4 may be used for the second insulation layer 6, ink produced by mixing and agitating a low dielectric substance with fluorine binder may be also used. As shown in FIG. 2, a C-shaped arcuate aperture 6*a* is formed in the second insulation layer 6, and the back electrode layer 5 is exposed in the aperture as an exposed portion 5*a* of the back electrode layer. A contact layer 5*b* of the back electrode layer 5 is formed on the exposed portion 5*a* by using silver paste.

A C-shaped arcuate contact layer 2*c* of the transparent electrode layer 2 is formed on a surface of the second insulation layer 6 and on the take-out electrode 2*b* by using silver paste or the like so as to electrically connect the contact layer 2*c* with the take-out electrode 2*b* of the transparent electrode layer 2. The contact layer 5*b* of the back electrode layer 5 and the contact layer 2*c* of the transparent electrode layer 2 are formed in the shape of concentric arcs with the contact layer 2*c* extending to the peripheral side of the EL display.

A back protection layer 7 is formed on the second insulation layer 6 such that part of the contact layers 2*c* and 5*b* of the transparent electrode layer and the back electrode layer, respectively, are exposed. The back protection layer 7 is formed of an insulating material such as silicon and vinyl chloride. The contact layer 5*b* of the back electrode layer 5 is exposed through an aperture 7*a* of the back protection layer 7 and the contact layer 2*c* of the transparent electrode layer 2 is exposed through an aperture 7*b*.

By constructing the EL display as described above, contact terminal portions 8*a* and 8*b* of a driving control circuit 10 may be connected selectively to arbitrary points on the C-shaped arc contact layers 2*c* and 5*b*, thus allowing the connection to be made readily and conveniently. Further, because these connection points are located on the back or rear of the luminescent area, they do not reduce the luminescent area, and the non-luminescent area is limited only to a range of the exposed portion 2*a* which is limited to a very small localized peripheral portion of the transparent electrode layer 2. For example, the contact terminal portion 8*a* of the driving control circuit may be connected selectively to an arbitrary point so long as it is on the circular arc of the contact layer 5*b*, and the contact terminal portion 8*b* may be connected selectively to an arbitrary point so long as it is on the circular arc of the contact layer 2*c*.

It is noted that because the positions of the contact terminal portions 8*a* and 8*b* for the driving control circuit 10 are determined in advance, it is possible to open the apertures on the back protection layer 7 at positions corresponding to the contact terminal portions 8*a* and 8*b* and to otherwise cover and protect all of the other parts except the apertures. That is, if the arcuate contact layers 2*c* and 5*b* are formed in advance as described above, it is possible to make the printing screens for each of the other layers, from the transparent electrode layer 2 to the second insulation layer 6 as well as the contact layer 2*c*, of common, standard construction and to accommodate different models in which the contact terminal portions are positioned in a variety of positions simply by changing the printing screen of the back projection layer 7 so that the apertures 7*a* and 7*b* are formed at the positions corresponding to the positions of the contact terminal portions 8*a* and 8*b* of the driving control circuit.

Figure 3:
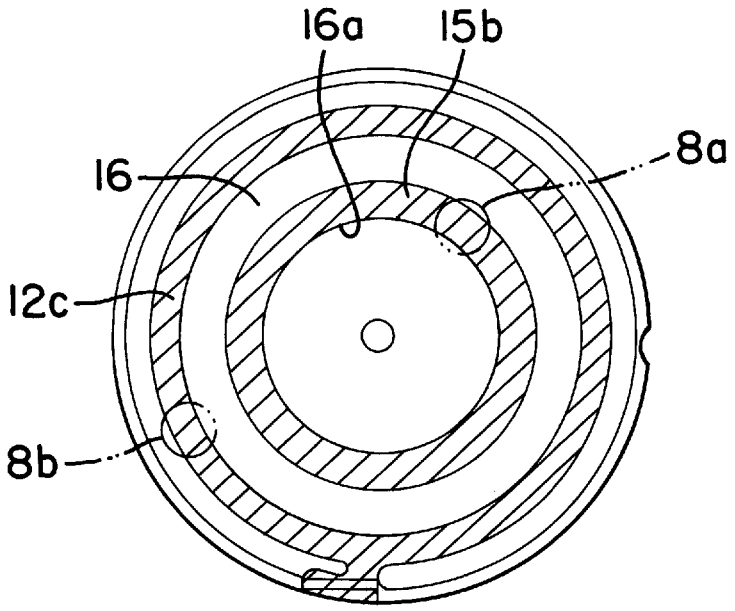
FIG. 3 is a rear view of another embodiment showing other contact layers in the same state as that in FIG. 2.

FIG. 3 shows an embodiment in which a contact layer 12*c* of the transparent electrode layer and a contact layer 15*b* of the back electrode layer are formed in the shape of concentric rings, wherein a back protection layer (not shown) is formed in the same manner as that described above after positioning the contact layer 15*b* within a ringed aperture 16*a* of a second insulation layer 16. Contact terminal portions 8*a* and 8*b* of the driving control circuit are shown by two-dot chain lines, respectively.

Figure 4:
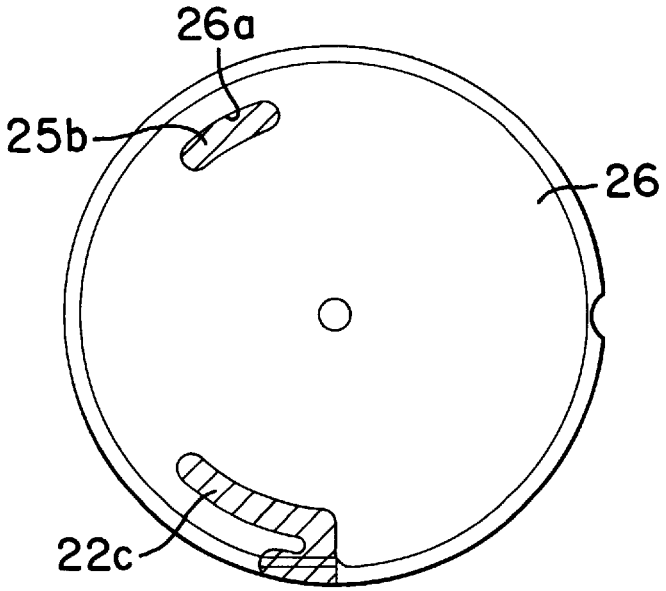
FIG. 4 is a rear view of another embodiment showing other contact layers in the same state as that in FIG. 2.

FIG. 4 shows an embodiment in which an arc aperture 26*a* is opened at the peripheral portion of a second insulation layer 26 and a contact layer 25*b* of the back electrode layer is provided within the aperture 26*a* when the positions of the contact terminal portions 8*a* and 8*b* (not shown) for the driving control circuit are limited further. A contact layer 22*c* of the transparent electrode layer is also formed in an arc at another part of the peripheral portion of the second insulation layer 26.

Figure 5:
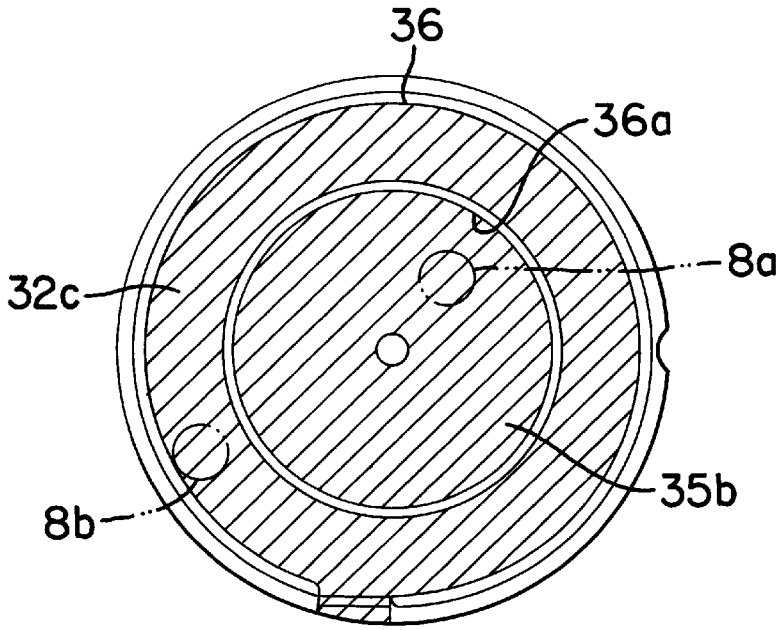
FIG. 5 is a rear view of a further embodiment showing other contact layers in the same state as that in FIG. 2.

FIG. 5 shows an embodiment devised so that the contact terminal portions 8*a* and 8*b* of the driving control circuit may be connected selectively in a wider range, wherein a circular aperture 36*a* is opened at the center part of a second insulation layer 36, and a circular contact layer 35*b* of the back electrode layer is provided within the aperture 36*a*. A contact layer 32*c* of the transparent electrode layer is formed in a ring-like or annular shape around the peripheral portion of the aperture 36*a* of the second insulation layer 36. The remaining structure is the same as that described above. This structure allows the contact terminal portion 8*a* of the driving control circuit to be connected at any position on the circular contact layer 35*b* within the aperture 36*a* and the contact terminal portion 8*b* to be connected at any position on the peripheral ring-like contact layer 32*c*, thus widening the selective range remarkably.

Figure 6:
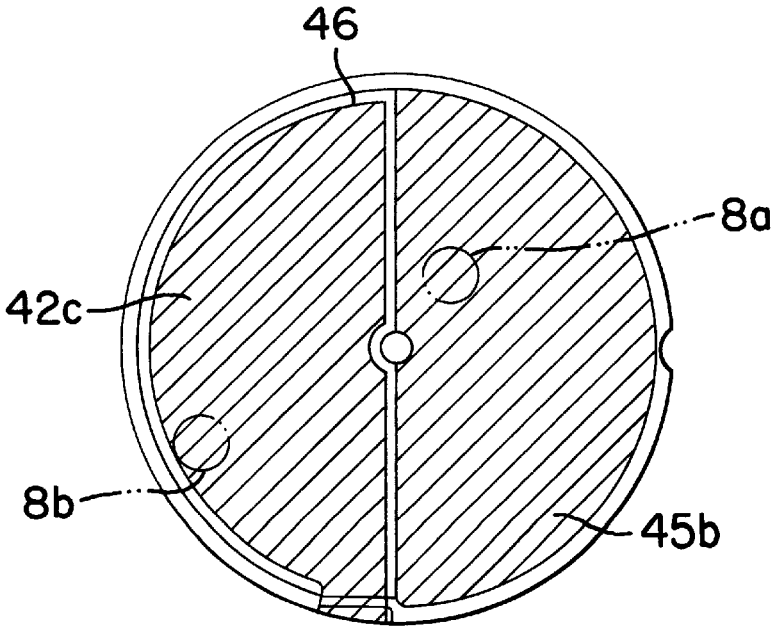
FIG. 6 is a rear view of another embodiment showing other contact layers in the same state as that in FIG. 2.

FIG. 6 shows an embodiment in which a second insulation layer 46 is formed on a left half part of the back electrode layer and a contact layer 45*b* of the back electrode layer is formed on the right half part. A contact layer 42*c* of the transparent electrode layer is formed on the second insulation layer 46. This structure allows the contact terminal portion 8*a* of the driving control circuit to be connected at any position on the right semi-circular contact layer 45*b* and the contact terminal portion 8*b* to be connected at any position on the left semi-circular contact layer 42*c*, thus widening a selective range remarkably.

Figure 7:
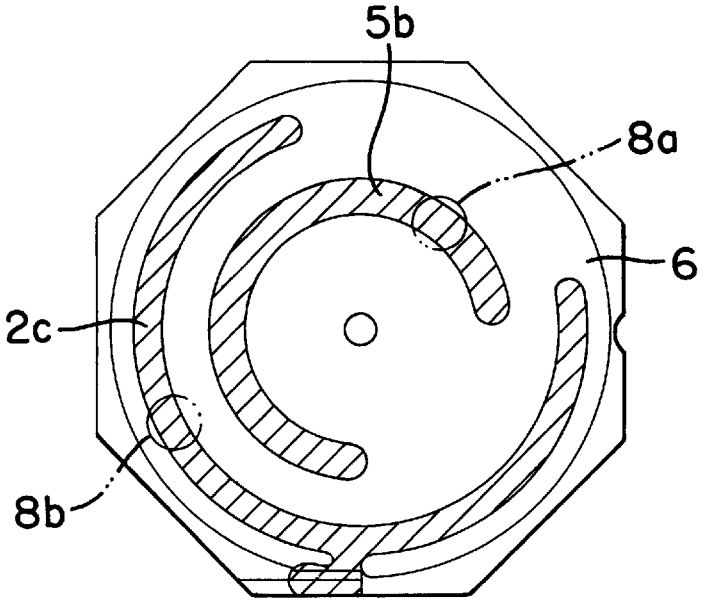
FIG. 7 is a rear view of a further embodiment having an octagonal outside shape and showing a state before the back protection layer is formed.
Figure 8:
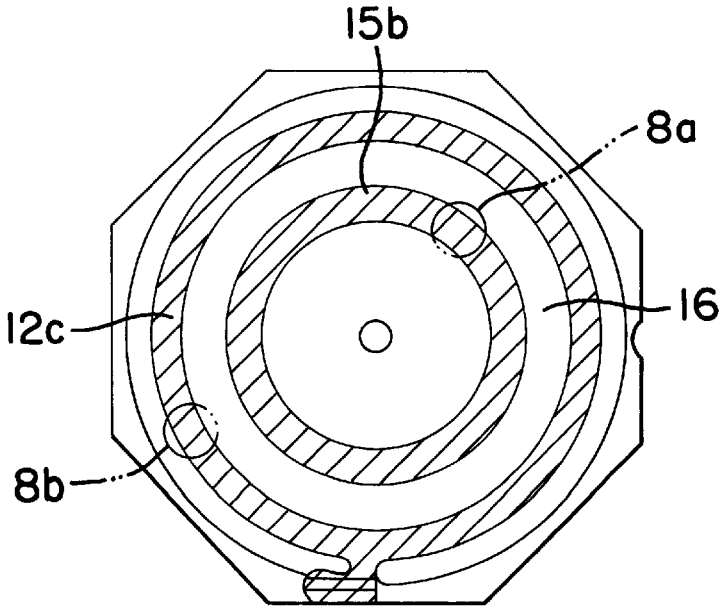
FIG. 8 is a rear view of another embodiment showing other contact layers in the same state as that in FIG. 7.
Figure 9:
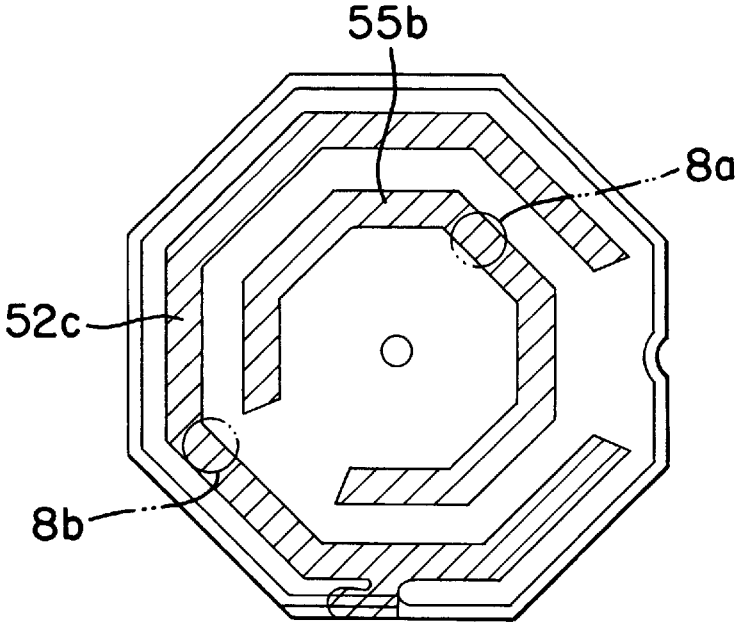
FIG. 9 is a rear view of a further embodiment showing other contact layers in the same state as that in FIG. 7.
Figure 10:
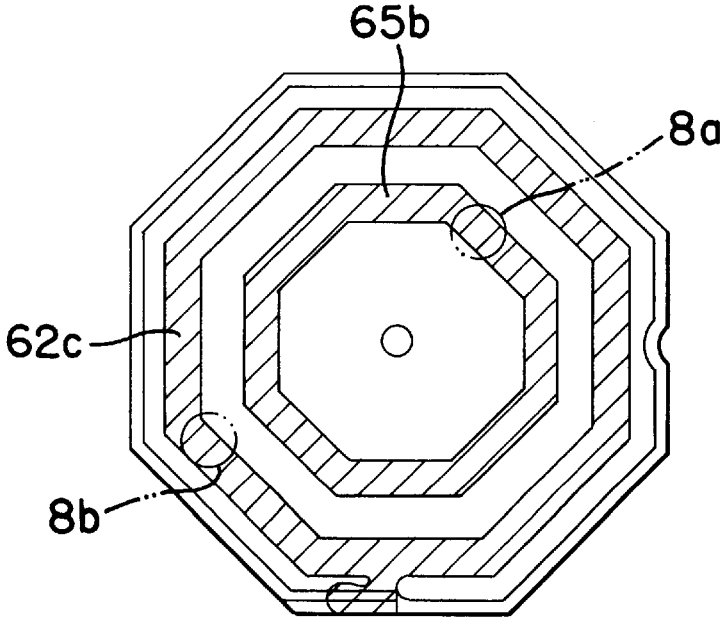
FIG. 10 is a rear view of another embodiment showing other contact layers in the same state as that in FIG. 7.

FIGS. 7 to 10 show embodiments in which the outer shape of the EL display is octagonal. FIGS. 7 and 8 show embodiments in which the same contact layers 2*c*, 5*b* and 12*c*, 15*b* as those described in FIGS. 2 and 3 are provided, respectively. FIGS. 9 and 10 show embodiments in which contact layers are formed with a predetermined width in parallel with each side of the octagonal outer shape. FIG. 9 shows contact layers 52*c* and 55*b* having an octagonal shape except that one leg or side of the octagon is cut out, and FIG. 10 shows contact layers 62*c* and 65*b* having a complete octagonal shape. All of the other structure of all the embodiments shown in FIGS. 3–10 is substantially the same as that shown in FIGS. 1 and 2.

As described above, the embodiments in which the contact layers are formed in the shapes of concentric arcs or rings accommodate a wide degree of angular or rotational movement of the contact layers of the EL display relative to the contact terminal portions of the driving control circuit during mounting and assembly. Further, the embodiments in which the contact layers are formed of linear portions, such as an octagon, accommodate a wide degree of relative linear movement during mounting and assembly.

As described above, the respective contact layers of the transparent electrode layer and the back electrode layer of the EL display which are to be connected with the contact terminal portions of the driving control circuit are formed on the back of the back electrode layer which is superimposed on the luminescent region or area, so that the non-luminescent area does not extend toward the outside and almost the whole area may be used as the luminescent area. Further, because the positions at which the contact layers of the EL display which are to be connected with the contact terminal portions of the driving control circuit are not limited to a narrow range and no precision positioning is required, it becomes easy to assemble. The extent to which the contact layers need be exposed may be minimized and damage which might be otherwise caused by contact with the contact layers and the like may be prevented by providing the back protection layer.

We claim:

1. An EL display comprising:

a transparent electrode layer formed on a surface of a transparent substrate;

a luminescent layer, a first insulation layer and a back electrode layer formed successively on the transparent electrode layer except for a peripheral portion thereof which is left uncovered as an exposed portion;

a second insulation layer formed on the back electrode layer except for a part thereof which is left uncovered as an exposed portion;

a contact layer of the back electrode layer formed on the exposed portion of the back electrode layer;

a contact layer of the transparent electrode layer electrically connected with the exposed portion of the transparent electrode layer formed on a surface of the second insulation layer; and contact terminal portions of an external driving control circuit connected with the respective contact layers of the transparent electrode layer and the back electrode layer.

2. An EL display according to claim 1; including a back protection layer made of an insulating material and formed on the back electrode layer and having apertures through which are exposed the contact layers of the back electrode layer and the transparent electrode layer.

3. An EL display according to claim 1; wherein the respective contact layers of the transparent electrode layer and the back electrode layer are formed in the shape of concentric arcs.

4. An EL display according to claim 3; including a back protection layer made of an insulating material and formed on the back electrode layer and having apertures through which are exposed the contact layers of the back electrode layer and the transparent electrode layer.

5. An EL display according to claim 1; wherein the contact layer of the back electrode layer is formed in a circle at the center part of the back electrode layer and the contact layer of the transparent electrode layer is formed in a ring-like shape around the circle.

6. An EL display according to claim 5; including a back protection layer made of an insulating material and formed on the back electrode layer and having apertures through which are exposed the contact layers of the back electrode layer and the transparent electrode layer.

7. An EL display according to claim 1; wherein the contact layer of the back electrode layer is formed in a semi-circle and the contact layer of the transparent electrode layer is formed in another semi-circle which opposes the semi-circle contact layer of the back electrode layer.

8. An EL display according to claim 7; including a back protection layer made of an insulating material and formed on the back electrode layer and having apertures through which are exposed the contact layers of the back electrode layer and the transparent electrode layer.

9. An EL display comprising:

a transparent substrate;

a first electrode layer made of a transparent material disposed on the transparent substrate;

a luminescent layer, a first insulation layer and a second electrode layer disposed successively on a surface of the first electrode layer except for a preselected surface portion thereof defining an exposed portion;

a second insulation layer disposed on a surface of the second electrode layer except for a preselected surface portion thereof defining an exposed portion;

a first contact layer disposed on the exposed portion of the second electrode layer for electrical connection to an external driving control circuit; and a second contact layer disposed on the second insulation layer for electrical connection to the exposed portion of the first electrode layer and to the external driving control circuit.

10. An EL display according to claim 9; further comprising a protection layer made of an insulating material and disposed on the second electrode layer, the protection layer having apertures through which are exposed the first and second contact layers.

11. An EL display according to claim 9; wherein the first and second contact layers are generally arc-shaped and are disposed in concentric relation to each other.

12. An EL display according to claim 11; further comprising a protection layer made of an insulating material and disposed on the second electrode layer, the protection layer having apertures through which are exposed the first and second contact layers.

13. An EL display according to claim 9; wherein the first contact layer is generally circular-shaped and is disposed at a center portion of the second electrode layer; and wherein the second contact layer is generally ring-shaped and is disposed around the first contact layer.

14. An EL display according to claim 13; further comprising a protection layer made of an insulating material and disposed on the second electrode layer, the protection layer having apertures through which are exposed the first and second contact layers.

15. An EL display according to claim 9; wherein the first contact layer is generally semicircular-shaped; and wherein the second contact layer is generally semicircular-shaped and disposed opposite the first contact layer.

16. An EL display according to claim 15; further comprising a protection layer made of an insulating material and disposed on the second electrode layer, the protection layer having apertures through which are exposed the first and second contact layers.

17. An EL display according to claim 9; wherein the first and second contact layers are generally arc-shaped.

18. An EL display according to claim 9; wherein the first and second contact layers are generally circular-shaped.

19. An EL display according to claim 9; wherein the first and second contact layers are generally semicircular-shaped.

20. An EL display according to claim 9; wherein each of the first and second contact layers comprises a plurality of linear portions connected together.

21. An EL display according to claim 20; wherein the first and second contact layers are generally octagonal-shaped.

* * * * *